United States Patent [19]

Ashley

[11] 3,984,893

[45] Oct. 12, 1976

[54] VACUUM SWEEPER DEVICE

[76] Inventor: Marion L. Ashley, 3784 Exchange Ave., Naples, Fla. 33940

[22] Filed: Apr. 22, 1975

[21] Appl. No.: 570,440

[52] U.S. Cl. ..... 15/339; 15/340; 15/352; 56/13.1; 56/DIG. 8; 180/53 R

[51] Int. Cl.[2] ..... A47L 9/00

[58] Field of Search ..... 15/339, 340, 347, 352; 56/13.1, DIG. 8; 180/53 R

[56] References Cited

UNITED STATES PATENTS

| | | | |
|---|---|---|---|
| 1,355,787 | 10/1920 | Skillins | 56/13.1 |
| 2,493,422 | 1/1950 | Sartin | 56/13.1 X |
| 2,736,151 | 2/1956 | McKenzie | 56/13.1 |
| 3,203,022 | 8/1965 | Clarke | 15/340 |
| 3,624,989 | 12/1971 | Catheridge | 15/347 X |
| 3,903,565 | 9/1975 | Hicks | 15/340 X |

FOREIGN PATENTS OR APPLICATIONS

| | | | |
|---|---|---|---|
| 417,663 | 2/1967 | Switzerland | 15/340 |

*Primary Examiner*—Christopher K. Moore
*Attorney, Agent, or Firm*—Edward F. Levy

[57] ABSTRACT

A vacuum sweeper device for use with a tractor-type rotary mower has a vacuum blower which is mounted on a frame and which is driven by a drive shaft connected to the power-take-off of the tractor. The frame is attached to the rear of the main frame of the tractor and includes provision for removably mounting a cylindrical container which collects material picked up by the vacuum blower.

9 Claims, 3 Drawing Figures

VACUUM SWEEPER DEVICE

The present invention relates in general to vacuum sweeper devices and more particularly to a lawn-type vacuum sweeper device for use with a tractor-type mower.

Conventional vacuum sweeper devices for tractor-type rotary mowers comprises a two wheeled trailer on which is mounted a vacuum blower and an internal combustion engine for driving the vacuum blower. The trailer also includes a integral container for receiving grass clippings, leaves, trash and the like collected by a first flexible hose which leads to the vacuum blower. A second flexible hose leads from the vacuum blower to the integral container. In use, the trailer is hitched to a conventional tractor-type riding mower and the end of the first flexible duct is attached to the housing of the rotary mower. The operator then starts the internal combustion engine and drives the tractor while vacuuming an area.

Among the disadvantages of conventional vacuum sweeper devices is the relatively long length of the combination of the tractor and the conventional vacuum sweeper device trailer. This long length limits maneuverability and prevents easy access to restricted areas, thus necessitating time consuming and consequently costly manual sweeping of such areas. In addition, when used by commercial landscape gardners, who often work at several job locations during the course of a single day, the relatively great length of the conventional vacuum sweeper device makes moving the device by truck inconvenient and therefore inefficient.

Another disadvantage of the conventional vacuum sweeper device is the integral container which is mounted on the trailer. When used by commercial landscape gardners, the integral container must be emptied several times each day. During these periods both the tractor and the vacuum sweeper device are inoperative, thus resulting in a loss of productive time. In addition to the above disadvantages, the operation of the separate internal combustion engine which drives the vacuum blower results in a requirement for periodic adjustment and frequent maintenance.

It is an object of the present invention to provide a vacuum sweeper device for tractor-type mowers in which the vacuum blower is driven by the engine of the tractor, thus eliminating the need for a separate internal combustion engine for the vacuum blower.

Another object of the invention is to provide a vacuum sweeper device which is mounted on an extension of a tractor frame thus eliminating the need for a wheeled trailer.

Another object of the invention is to provide a vacuum sweeper device adapted for holding and filling removable containers.

Still another object of the invention is to provide a vacuum sweeper device which is compact, relatively light in weight, economical in manufacture and which can be produced at a relatively low unit cost.

In accordance with the present invention there is provided a vacuum sweeper device for tractor-type rotary mowers in which a vacuum blower is operated by a drive shaft assembly connected to the engine of the tractor. The vacuum blower is mounted on a frame which is attached to the rear of the main frame of the tractor and the frame includes provision for removably mounting a conventional garbage can, or similar cylindrical container. A first flexible duct leads from the rotary mower housing to the vacuum blower and a second flexible duct leads from the vacuum blower to a hood which removably fits over the top of the removable container. The vacuum blower is driven by the tractor engine through a drive shaft assembly which is connected to the power-take-off of the tractor engine. The drive shaft assembly is positioned within the envelope of the frame of the vacuum sweeper device thus preventing accidental contact with the drive shaft assembly, which may result in injury.

Additional objects and advantages of the invention will become apparent during the course of the following specification, when taken in connection with the accompanying drawings, in which.

Figure 1:
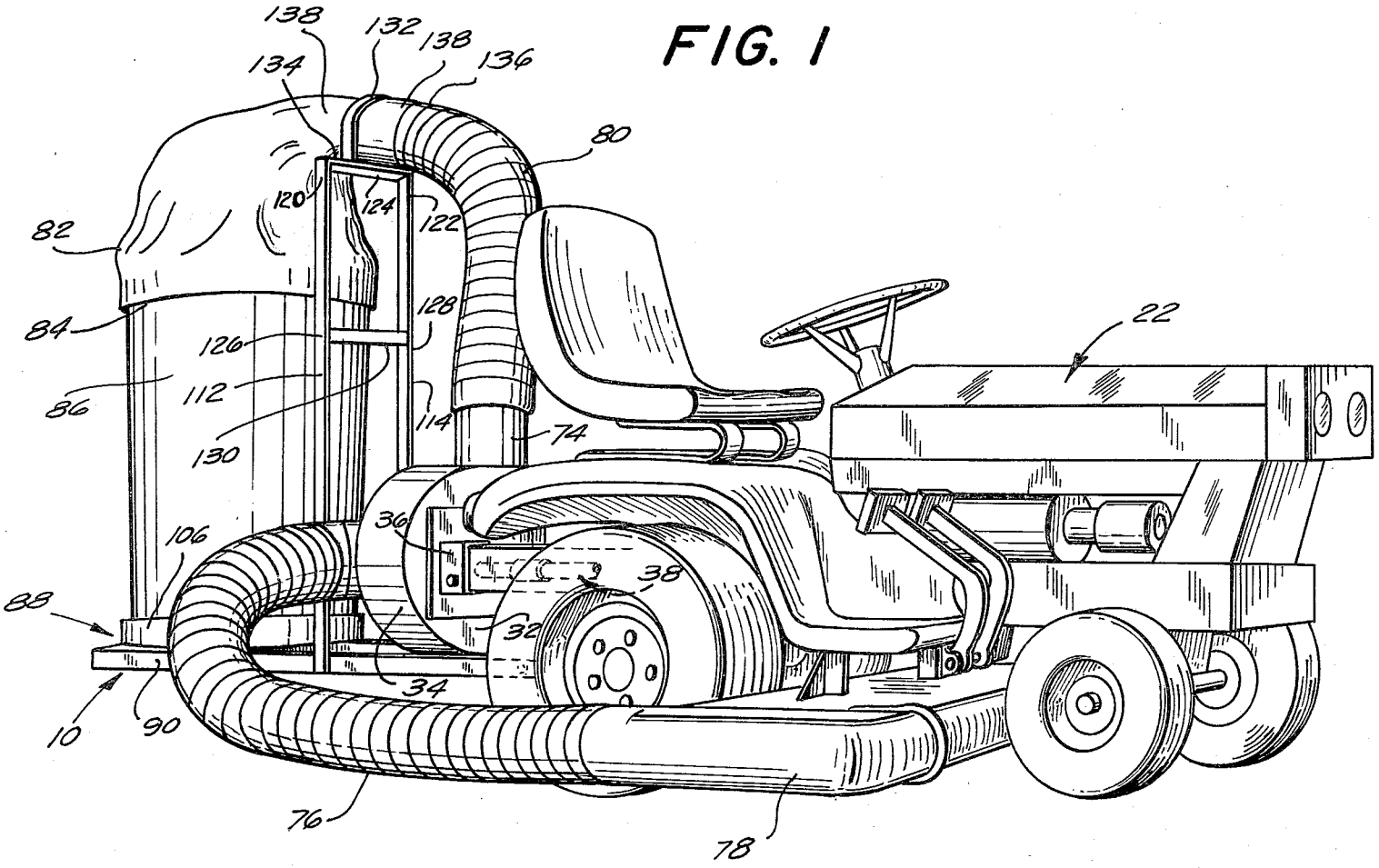
FIG. 1 is an overall perspective view of a vacuum sweeper device made in accordance with the present invention and shown mounted on a tractor-type rotary mower.
Figure 3:
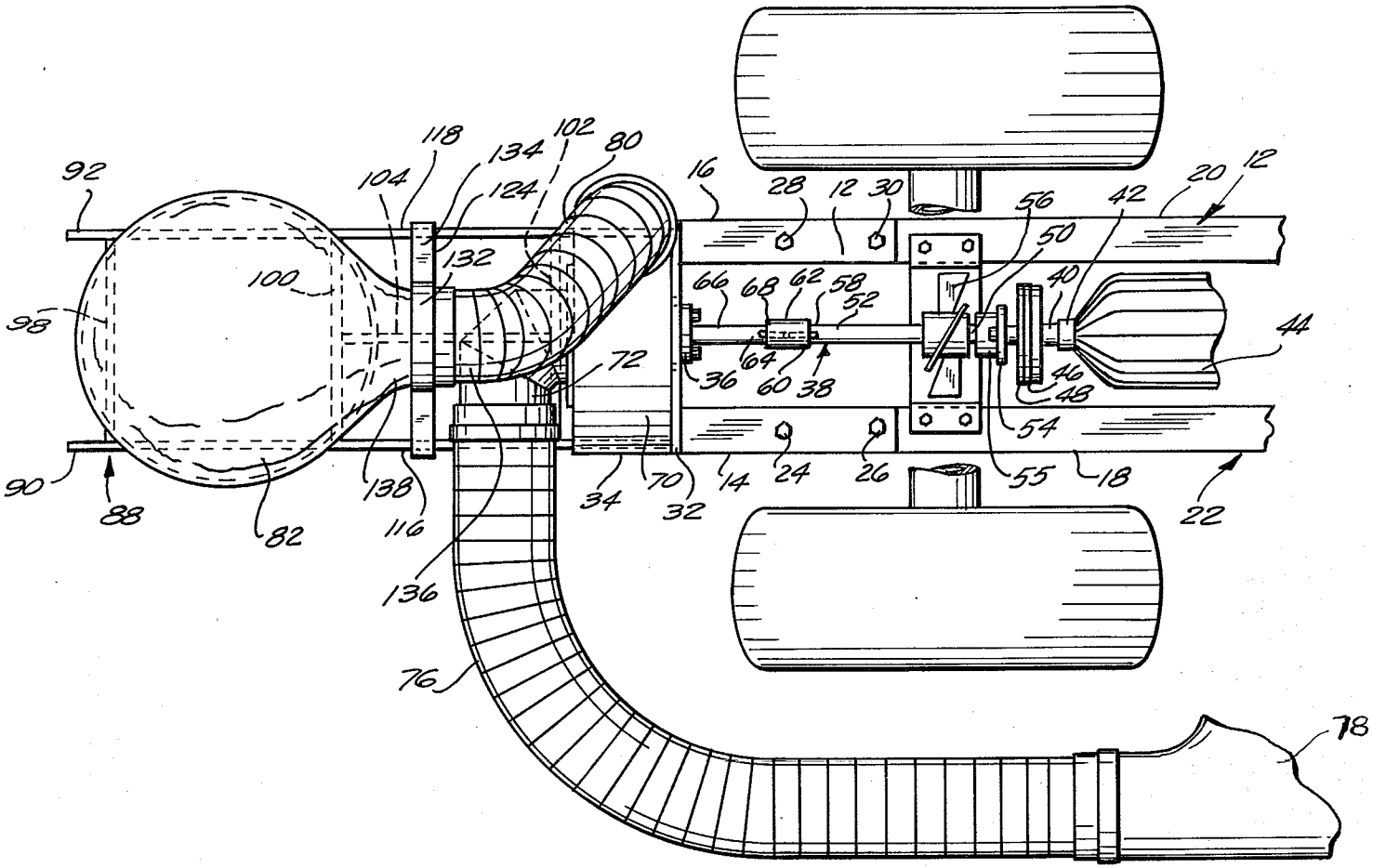
FIG. 3 is a top plan view of the vacuum sweeper device of FIG. 1 and the rear portion of the tractor, with portions thereof being broken away.

Referring in detail to the drawings, there is shown in FIG. 1 a preferred embodiment of a vacuum sweeper device 10 made in accordance with the present invention. As shown in FIG. 3, the vacuum sweeper device 10 includes a support frame 12 which has a pair of spaced apart longitudinal members 14 and 16 which are attached to the main frame members 18 and 20 of a tractor-type riding mower 22 by means of bolts 24, 26, 28 and 30. The support frame 12 includes a vertical plate 32 on which is mounted a vacuum blower 34 and a self-aligning bearing 36.

The vacuum blower 34 is driven by a shaft assembly 38 which includes a first drive hub 40 connected to the power-take-off 42 of the transmission 44 of the tractor-type riding mower 22. The first side 46 of a flexible coupling 48 is connected to the first drive hub 40 and the first end 50 of a first shaft 52 is connected to the second side 54 of the flexible coupling 48 by a second drive hub 55.

A fan blade 56 is mounted on the first shaft 52 relatively close to the first end 50 of said first shaft 52 for the purpose of cooling the transmission 44. The second end 58 of the first shaft 52 is connected to the first end 60 of a coupling 62. The first end 64 of a second shaft 66 is connected to the second end 68 of the coupling 62. The second shaft 66 is supported in part by the self aligning bearing 36 and the second end of the second shaft 66 is connected to an impeller (which is not shown) located inside the vacuum blower housing 70.

The shaft assembly 38 is disposed between the two longitudinal members 14 and 16 and at an elevation which is generally in line with the midpoint of the height of the longitudinal members 14 and 16. This location of the shaft assembly 38 serves to restrict accidental access to the shaft assembly 38 thus providing a safety feature.

Figure 2:
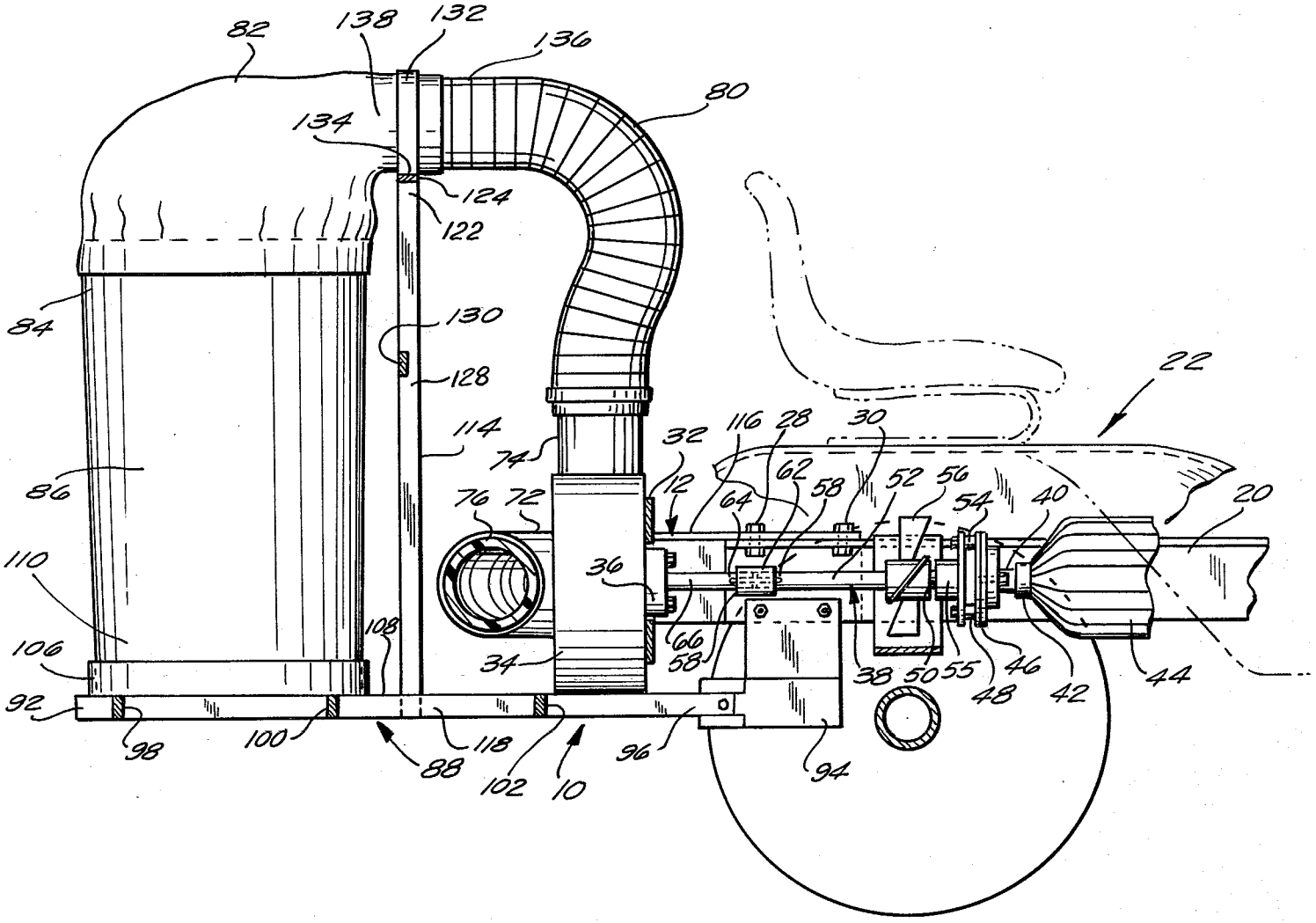
FIG. 2 is a side elevational view of the vacuum sweeper device of FIG. 1 and the rear portion of the tractor, with portions thereof broken away and shown in section and in phantom to reveal details of the coupling for the vacuum sweeper device.

The vacuum blower 34 has an inlet port 72 and a discharge port 74. A first flexible hose 76 leads from the boot 78 of the rotary mower to the inlet port 72 and a second flexible hose 80 leads from the discharge port 74 to a flexible hood 82 which fits over the top 84 of a garbage can or similar cylindrical container 86. The container 86 is supported on a container frame 88 which includes a pair of spaced apart horizontal support members 90 and 92, which are attached to a pair of brackets 94, one of which is shown in FIG. 2. The bracket 94 is bolted to the main frame member 20 of the tractor mower 22 and projects downward from the main frame member 20 to support the end 96 of the horizontal support member 92. The container frame 88 also includes transverse members 98, 100 and 102 and a longitudinal member 104, disposed between transverse members 100 and 102. A container retainer ring 106 is attached to the top surface 108 of the container frame 88 and is proportioned to receive and removably retain the lower portion 110 of the container 86.

A pair of vertical members 112 and 114 project upward, one each, from intermediate portions 116 and 118 of the support members 90 and 92. The upper ends 120 and 122 of the vertical members 112 and 114 are joined by a first horizontal member 124 and intermediate portions 126 and 128 of the vertical members 112 and 114 and joined by a second horizontal member 130. A clamp 132 is mounted on the top surface 134 of the first horizontal member 124 and serves to retain the end 136 of the second flexible hose 80 and a neck portion 138 of the hood 82, which is closely fitted to the end 136, and into which the end 136 projects. The hood 82, which may be made of fabric or flexible plastic, conducts material that is being vacuumed into the container 86.

In use, as the tractor 22 is driven over a lawn, the rotary motor mounted therebeneath operates in the usual manner to cut the grass. The clippings, leaves and other lawn debris are picked up by the vacuum condition within the boot 78 and conveyed through the flexible hose 76 to the interior of vacuum blower 34 and thence through the hose 80 to the interior of the container 86. When the container 86 is filled, the hood 82 is easily lifted off the top 84 of the container 86 and the container 86 is lifted out of the container retainer ring 106 and is either emptied and then replaced or alternatively, an empty container may be used to replace the filled container 86. In either case the non-productive time for the vacuum sweeper device 10 is relatively short.

By connecting the vacuum blower directly to the power-take-off of the tractor, the conventional use of a separate internal combustion engine for the vacuum blower is eliminated. This results in the vacuum blower operating more easily and being considerably more manageable since it is a complete unit. In addition, less maintenance, repair and replacement of parts is effected, as well as economy in the use of fuel and oil.

In the preferred embodiment of the invention, the vacuum blower 34 and container 86 are mounted on the auxiliary frame 12 and 88 which is rigidly affixed to the rear of the tractor. As an alternative, however, the vacuum blower and container may be mounted on a wheeled cart or trailer which is hitched to the tractor and drawn along thereby.

The flexible coupling 48 and the coupling 62 provide a flexible connection between the vacuum blower and the power-take-off of the tractor, which permits a slight degree of movement between these parts as the tractor is running. In addition, these couplings permit sufficient adjustability in the coupling of the vacuum blower to the tractor, enabling the vacuum sweeper device to be mounted on a variety of tractors of different types having hydrostatic drives.

While preferred embodiments of the invention have been shown and described herein, it is obvious that numerous additions, changes and ommissions may be made in such embodiments without departing from the spirit and scope of the invention.

What is claimed is:

1. A vacuum sweeper device for a tractor having a power-take-off and including a rotary mower assembly, said vacuum sweeper device, comprising a support frame, attachment means for rigidly securing said support frame to said tractor, a vacuum blower attached to said support frame and having an inlet port, a discharge port, and a drive shaft, a container frame secured to said support frame, container means removably mounted on said container frame, inlet hose means leading to said inlet port of said vacuum blower, discharge hose leading from said discharge port of said vacuum blower to said container means, said support frame being positioned to locate the attached vacuum blower with its drive shaft in axial alignment with said power-take-off, and driving connection means connected to said power-take-off of said tractor and to said drive shaft of said vacuum blower for driving said vacuum blower while said rotary mower assembly is operating.

2. A vacuum sweeper device for a tractor having a power-take-off, according to claim 1 further including container retaining means on said container frame for retaining said container means, said container retaining means comprising a retainer ring on the top surface of said container frame and sized to removably receive the lower end of said container means.

3. A vacuum sweeper device for a tractor having a power-take-off, according to claim 2 in which said container means comprises a rigid cylindrical container having an open top and a closed lower end removably received within said retainer ring.

4. A vacuum sweeper device for a tractor having a power-take-off, according to claim 1 in which said discharge hose means comprises a hollow hood removably covering said container means and a flexible hose having an end communicating with said hollow hood.

5. A vacuum sweeper device for a tractor having a power-take-off, according to claim 1 in which said support frame comprises a pair of spaced apart horizontal members secured at one end to said tractor and a vertical plate, for attaching said vacuum blower, with said vertical plate connecting said pair of horizontal members at the opposite, free ends thereof.

6. A vacuum sweeper device for a tractor having a power-take-off according to claim 1 further including attachment means for securing the forward end of said container frame to said support frame with said container frame projecting rearwardly of said support frame and said container means removably mounted on the rear end portion of said container frame.

7. A vacuum sweeper device for a tractor having a power-take-off, according to claim 6 further including a container retaining ring mounted on the rear end portion of said container frame for removably receiving said container means, and an upright support member secured to an intermediate portion of said container frame and having clamping means for retaining said discharge hose means.

8. A vacuum sweeper device for a tractor having a power-take-off, according to claim 1 in which said driving connection means includes flexible coupling means connected to said power-take-off of said tractor and to said aligned drive shaft.

9. A vacuum sweeper device for a tractor having a power-take-off, according to claim 8 in which said first shaft has a fan blade mounted for rotation with said drive shaft for cooling of adjacent portions of said tractor.

* * * * *